US007959048B1

(12) United States Patent
Cyr

(10) Patent No.: US 7,959,048 B1
(45) Date of Patent: Jun. 14, 2011

(54) EQUIPMENT BACKPACK WITH TRIPOD ATTACHMENT SYSTEM AND WING ACCESSORY POCKETS

(75) Inventor: Ryan Cyr, Hidden Hills, CA (US)

(73) Assignee: Tamrac, Inc., Chatsworth, CA (US)

( * ) Notice: Subject to any disclaimer, the term of this patent is extended or adjusted under 35 U.S.C. 154(b) by 1178 days.

(21) Appl. No.: 11/212,833

(22) Filed: Aug. 25, 2005

(51) Int. Cl.
*A45F 3/04* (2006.01)

(52) U.S. Cl. ..... 224/651; 224/652; 224/908

(58) Field of Classification Search ..... 224/651, 224/652, 908, 913, 915, 916, 917
See application file for complete search history.

(56) References Cited

U.S. PATENT DOCUMENTS

| | | | | | |
|---|---|---|---|---|---|
| 2,313,593 | A | * | 3/1943 | Smith | 224/578 |
| 2,576,559 | A | * | 11/1951 | Bennek | 224/149 |
| 3,963,103 | A | * | 6/1976 | Cowen, III | 206/315.1 |
| 4,096,978 | A | * | 6/1978 | Noice | 224/640 |
| 4,114,667 | A | * | 9/1978 | Belson | 224/613 |
| 4,561,576 | A | * | 12/1985 | Lowe et al. | 224/580 |
| 4,693,402 | A | * | 9/1987 | Comeau | 224/604 |
| 4,883,207 | A | * | 11/1989 | McArthur | 224/153 |
| D311,813 | S | * | 11/1990 | Oliver | D3/216 |
| 5,004,134 | A | * | 4/1991 | Barry | 224/650 |
| 5,018,652 | A | * | 5/1991 | Holtzclaw, Jr. | 224/150 |
| 5,205,448 | A | * | 4/1993 | Kester et al. | 224/575 |
| 5,465,887 | A | * | 11/1995 | Hudson | 224/651 |
| 5,575,412 | A | * | 11/1996 | Arias | 224/257 |
| 5,775,496 | A | * | 7/1998 | Cyr | 206/316.1 |
| 6,145,639 | A | * | 11/2000 | Roper | 190/102 |
| 6,290,114 | B1 | * | 9/2001 | Berberian | 224/642 |
| 6,367,674 | B1 | * | 4/2002 | Tabor | 224/650 |
| 6,702,167 | B2 | * | 3/2004 | Annis | 224/576 |

FOREIGN PATENT DOCUMENTS

FR 2631792 A1 * 12/1989

* cited by examiner

*Primary Examiner* — Justin M Larson
*Assistant Examiner* — John Cogill
(74) *Attorney, Agent, or Firm* — Thomas I. Rozsa

(57) ABSTRACT

An improved equipment backpack which incorporates two novel and unique features. The first feature is a unique system for holding a tripod in place so that it can be carried on the backpack. The second feature is the incorporation of wing accessory pockets on the exterior of the backpack which retain objects in a visible, organized and readily accessible manner so that easy access to the objects can be achieved without the necessity of opening the entire backpack.

22 Claims, 3 Drawing Sheets

EQUIPMENT BACKPACK WITH TRIPOD ATTACHMENT SYSTEM AND WING ACCESSORY POCKETS

BACKGROUND OF THE INVENTION

1. Field of the Invention

The present invention relates to the field of backpacks which incorporate pockets for retaining equipment which needs to be transported to various locations, which by way of example can be cameras; lenses and photographic accessories, motion picture film accessories, or other types of non-photographic equipment.

2. Description of the Prior Art

In general, backpacks having pockets for retaining different types of equipment including, but not limited to photographic equipment such as cameras, lenses and photographic accessories are known in the prior art. However, prior art equipment backpacks including prior art photographic backpacks lack several features which the present inventor believes are vital for a complete equipment backpack. First, prior art photographic equipment backpacks have inefficient and ineffective means to retain and carry a camera tripod. Second, prior art equipment backpacks of all types do not have exterior compartments which are conveniently accessible for retaining equipment and accessories. There is a significant need for an improved equipment backpack which addresses these two features.

SUMMARY OF THE INVENTION

The present invention is an improved equipment backpack which incorporates two novel and unique features. The first feature is a unique system for efficiently and effectively holding a tripod in place so that it can be carried on the backpack. The second feature is the incorporation of wing accessory pockets on the exterior of the backpack so that easy access to accessories can be achieved without the necessity of opening the entire backpack.

It has been discovered, according to the present invention, that if the equipment backpack includes on its rear exterior surface a bottom pocket with a pair of oppositely disposed closing means such as zippers, then two feet of a tripod can be securely held in the pocket with the zippers closing around either side of the two feet of the tripod. In addition, if the interior of the pocket is reinforced with plastic, the feet of the tripod will not tear through the pocket as the tripod is carried on the backpack.

It has further been discovered, according to the present invention, that if the backpack further includes a pair of oppositely disposed wing pockets located above the bottom pocket, with each wing pocket positioned to create an exterior channel on their respective inward sides, then two oppositely disposed legs of the tripod can be respectively positioned in a respective channel to thereby prevent the tripod from rocking side to side as it is carried on the backpack.

It has also been discovered, according to the present invention, that if a multiplicity of cinch straps are incorporated along the length of the area where the tripod is retained, the cinch straps when tied around the tripod at various vertical locations, will securely retain the tripod as it is carried on the backpack.

It has additionally been discovered, according to the present invention, that if a pair of wing pockets are incorporated into the exterior of the backpack, then equipment and accessories retained within the wing pockets can be easily organized and accessed without the necessity of opening the entire backpack.

It is therefore an object of the present invention to provide a unique means to efficiently, safely and securely retain a tripod on an equipment backpack.

It is another object of the present invention to provide a means for retaining equipment and accessories in an organized and easily accessible manner on the outside of a backpack so that it is not necessary to open the entire backpack to gain access to those equipment and accessories.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 6, several of the conventional features incorporated into the present invention equipment backpack 10 will be discussed first before the novel features of the present invention will be discussed.

Figure 3:
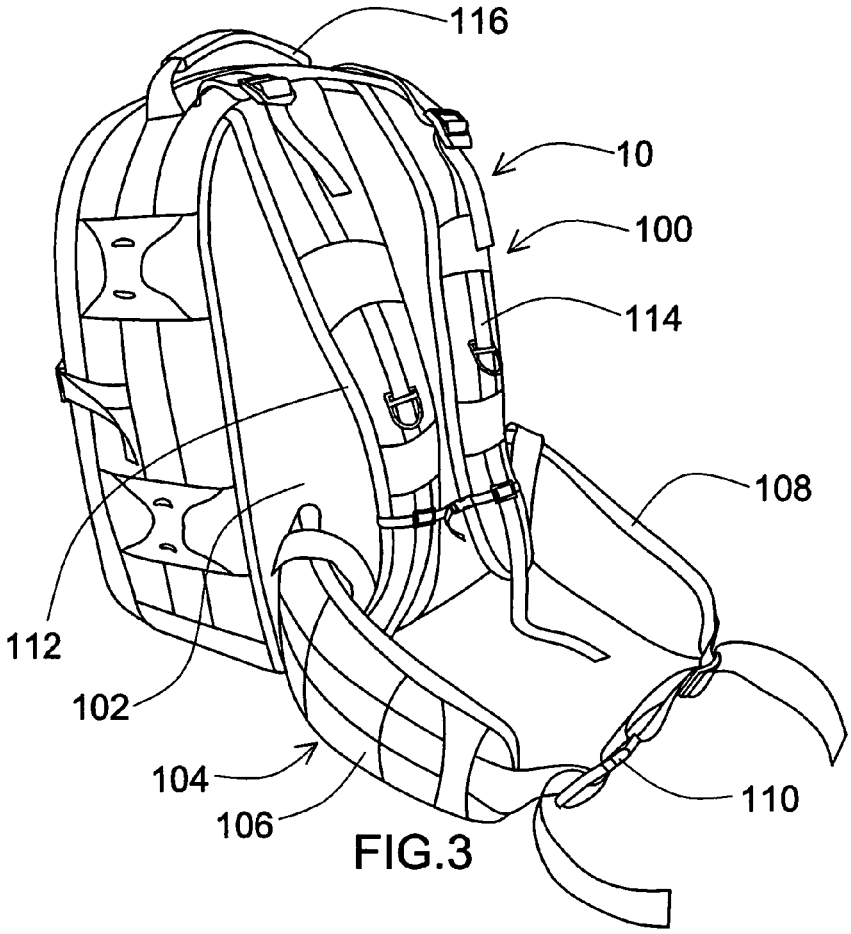
FIG. 3 is a perspective view showing the front of the present invention equipment backpack.
Figure 4:
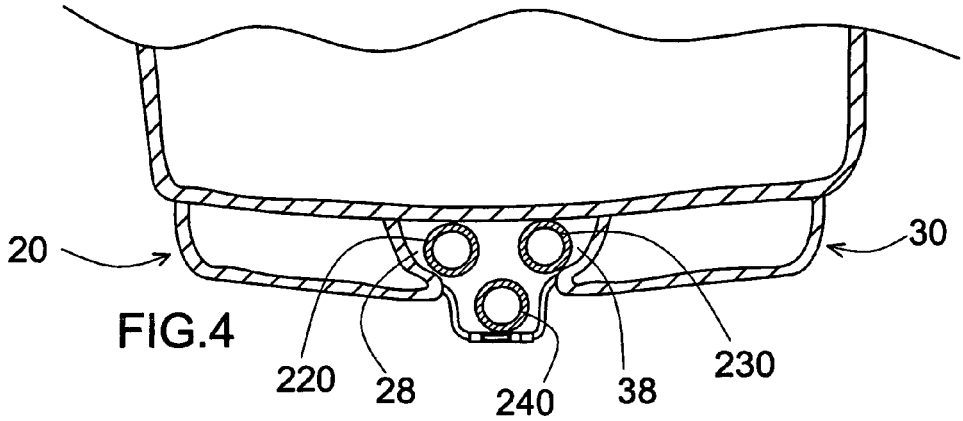
FIG. 4 is a cross-sectional view taken along line 4-4 of FIG. 2.

Referring to FIG. 3, the front 100 of the equipment backpack 10 has a front exterior surface 102 which rests against a person's back as the backpack is carried. Adjacent the lower portion of front surface 102 is waist belt 104 having a right section 106 and a left section 108 with connecting means 110 so that the equipment backpack 10 can be strapped around a person's waist. Extending the length of front surface 102 are a pair of parallel oppositely disposed shoulder straps 112 and 114 so that the equipment backpack can be carried on the person's shoulders with a respective arm placed through a respective shoulder strap. When not being worn, the equipment backpack 10 can be carried by a handle 116 located at the top of the equipment backpack 10.

Figure 6:
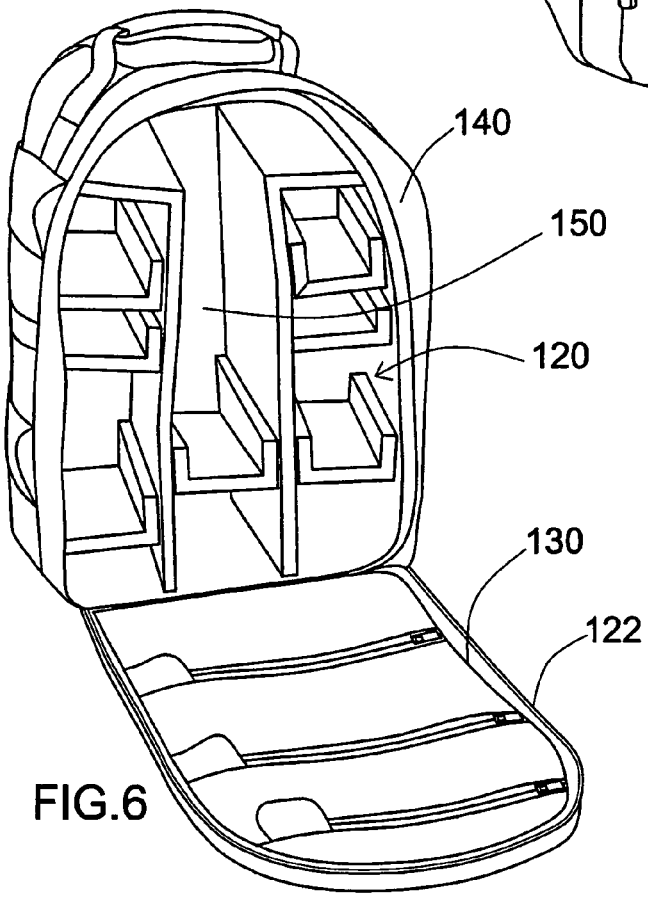
FIG. 6 is a perspective view of the present invention photographic equipment backpack with the main zipper unfastened to expose the interior pockets of the equipment backpack.

Referring to FIG. 6, the interior compartment 120 is illustrated. The interior compartment is accessed by opening large compartment zipper 122 so that the rear section 130 can fold outwardly from the main body 140 to gain access to the multiplicity of interior compartments 150 which are specially designed to retain many types of equipment such as photographic equipment including cameras, lenses, and photographic accessories. The pockets can be modified to hold larger and different types of equipment. After the desired equipment is removed from its interior compartment, the rear section 130 is rotated to be against the main body 140 and the large compartment zipper 122 is closed.

The novel features of the present invention are primarily incorporated into the rear face 132 of the rear section 130 of equipment backpack 10.

Figure 5:
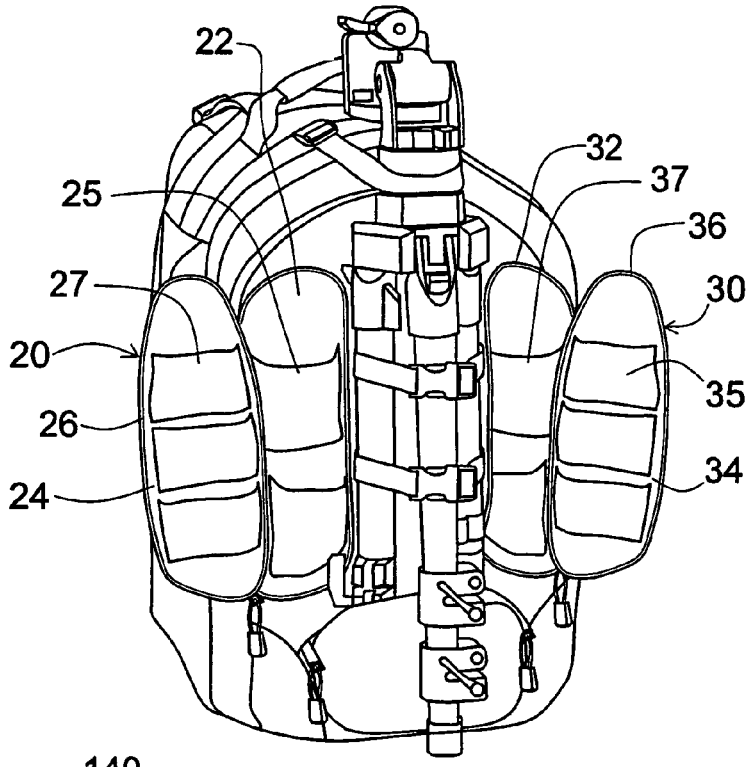
FIG. 5 is a perspective view of the rear of the present invention equipment backpack with the exterior wing pockets in the opened condition.

Referring to FIGS. 1, 2, 4 and 5, the first novel feature of the present invention is the incorporation of a pair of oppositely disposed pair of exterior wing accessory pockets. First exterior wing accessory pocket 20 is located on the left side of rear face 132 and has a main body 22 and a front cover 24 which is attached to the main body 22 along one side and is opened by closure means such as zipper 26. When in the opened condition as illustrated in FIG. 5, both the interior of the body 22 and the front cover 24 have pockets and compartments 25 and 27 which can house objects such as cell phones, memory cards, card readers, MP3 players, batteries, credit cards and many other small objects. A key feature of the present invention is that by incorporating the wing exterior pocket 20 into the outside of the equipment backpack 10 on the rear face 132 of rear section 130, these smaller items can be stored in a visible and organized manner so that they can be readily located and the items can be easily retrieved without having to open the entire equipment backpack to gain access to interior compartment 120. Optionally, a zip clip 29 can be included to lock first exterior wing accessory compartment 20. An additional key feature is the incorporation of a longitudinal channel 28 on the interior facing longitudinal wall of pocket 20.

Also referring to FIGS. 1, 2, 4 and 5, there is illustrated second exterior wing accessory pocket 30 which is located on the right side of rear face 132 and is generally parallel to first exterior wing accessory pocket 20. The two pockets 20 and 30 can be the same size or they can be of different sizes. In the illustrations, pocket 30 is the same size as pocket 20. Second exterior wing accessory pocket 30 has a main body 32 and a front cover 34 which is attached to the main body 32 along one side and is opened by closure means such as zipper 36. When in the opened condition as illustrated in FIG. 5, both the interior of the body 32 and the front cover 34 have pockets and compartments 37 and 35 which can house objects such as cell phones, memory cards, card readers, MP3 players, batteries, credit cards and many other small objects. A key feature of the present invention is that by incorporating the wing extension pocket 30 into the outside of the equipment backpack 10 on the rear face 132 of rear section 130, these small items can be stored in a visible and organized manner so that they can be readily located and the items can be easily retrieved without having to open the entire equipment backpack to gain access to the interior compartment 120. Optionally, a clip 39 can be included to lock second exterior wing accessories compartment 30. An additional key feature of the second exterior wing accessory pocket 30 is the incorporation of a longitudinal channel 38 on the interior facing longitudinal wall of pocket 30. Channels 28 and 38 are parallel to each other. Each channel 28 and 38 are each sized to accommodate a leg of a tripod.

Referring to FIGS. 1, 2, 4 and 5, the second novel feature of the present invention, is the incorporation of tripod retaining means to enable a tripod 200 to be efficiently, effectively, safely and securely carried on the equipment backpack 10. In general, a tripod 200 has a platform 210 having a first leg 220, a second leg 230 and a third middle leg 240. The three legs 220, 230 and 240 are rotatably connected adjacent the lower surface of platform 210. The upper surface of platform 210 supports camera mounting means 250.

The tripod retaining means is comprised of the following components. The first component is a bottom pocket 40 having a main body 42 and a front cover 44 with closure means with preferably a pair of zippers 46 and 48 which run along the same zipper track along opposite top portions of the main body 42 and front cover 44.

Figure 1:
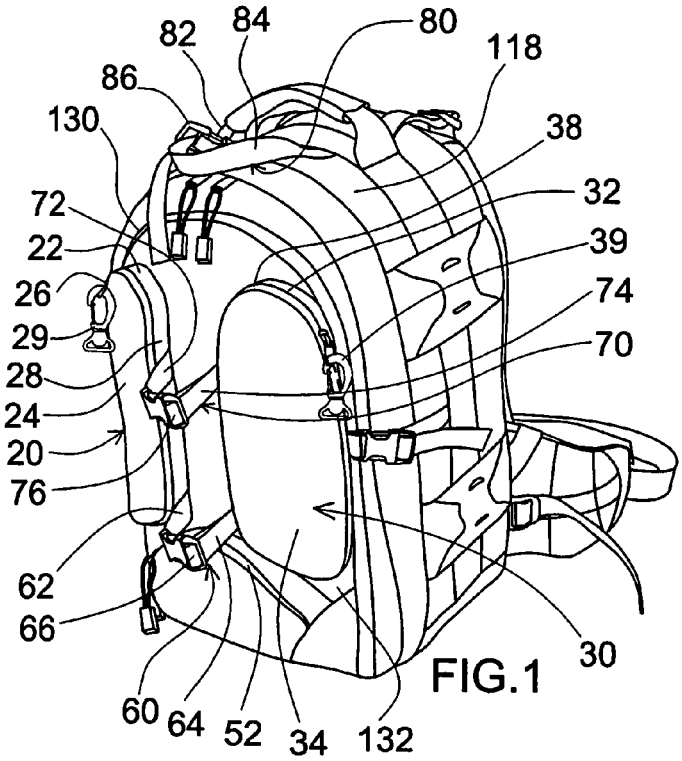
FIG. 1 is a perspective view of the rear of the present invention equipment backpack, illustrating the novel features of the present invention.
Figure 2:
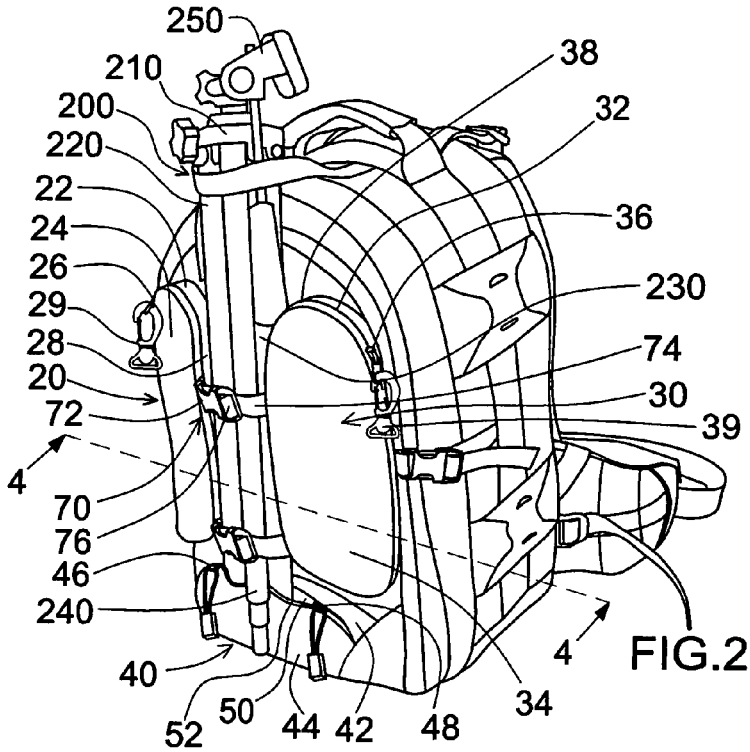
FIG. 2 is a perspective view of the rear of the present invention equipment backpack, illustrating the novel feature of the present invention with a tripod efficiently and effectively retained on the equipment backpack.

An interior compartment 50 is contained between main body 42 and front cover 44. Optionally, the compartment 50 can be reinforced with reinforcing means 52 which lines the entire interior compartment 50. By way of example, the reinforcing means can be plastic lining to provide additional strength and durability to the fabric pocket. The bottom pocket 40 is positioned below and spaced apart from first and second exterior wing accessory pockets 20 and 30 and aligned with the space between pockets 20 and 30. The tripod 200 is partially housed in bottom pocket 40 by having first leg 220 and second leg 230 placed into interior compartment 50 while third middle leg 240 rests immediately outside pocket 50 and rests against front cover 44 as illustrated in FIGS. 2 and 5. To further secure the bottom of legs 220 and 230 in compartment 50, the zippers 46 and 48 are brought into the closed position to close around and securely hold feet 220 and 230 of tripod 200 within compartment 50.

The second component of the tripod retaining means is a multiplicity of cinch straps which wrap around the three legs of the tripod to securely hold the legs against the rear face 132 of rear section 130 of equipment backpack 10. In the preferred embodiment, there are three cinch straps as illustrated but it will be appreciated that at least one cinch strap or any; multiplicity of cinch straps are within the spirit and scope of the present invention. Referring to FIGS. 1, 2, 4 and 5, first lower cinch strap 60 is comprised of a pair of oppositely disposed strap members 62 and 64, each attached at one end to rear face 132 at a location between wing pockets 20 and 30 and connected at their opposite ends by closure means 66 so that the cinch strap 60 is located immediately above bottom pocket 40 and adjacent the lower ends of exterior wing accessory pockets 20 and 30. Located higher up on rear face 132 and between pockets 20 and 30 is second middle cinch strap 70 which also is comprised of oppositely disposed strap members 72 and 74, each attached at one end to rear face 132 at a location between wing pockets 20 and 30 and connected at their opposite ends by closure means 76 so that the cinch strap 70 can be wrapped around the three tripod legs as illustrated. Second middle cinch strap is located approximately two-thirds of the distance up the two pockets 20 and 30. The third top cinch strap 80 is located at the top of the equipment backpack 10 and is comprised of oppositely disposed strap members 82 and 84, each attached at one end to the top 118 of equipment backpack 10 and connected at their opposite ends by closure means 86. The third top cinch strap wraps around the upper portion of the tripod 200 at a location above the three legs.

As an additional optional feature of the tripod retaining means, longitudinal channel 28 of first exterior wing accessory pocket 20 is designed to receive and support a portion of leg 220. Similarly, longitudinal channel 38 of second exterior wing accessory pocket 30 is designed to receive and support a portion of leg 230. The channels 28 and 38 enable the tripod 200 to be efficiently, safely and securely held on the equipment backpack 10 without rocking side to side when the equipment backpack 10 is carried.

Therefore, through use of the combination of the bottom pocket 40, the multiplicity of cinch straps 60, 70 and 80 and the channels 28 and 38, the tripod 200 is very securely retained on the equipment backpack 10 and can be easily transported along with the rest of the equipment retained within the equipment backpack.

Defined in detail, the present invention is an equipment backpack having a rear face and which can retain a tripod having a first leg, a second leg, and a third middle leg, the equipment backpack comprising: (a) a first exterior wing accessory pocket on one side of the rear face and having a main body and a front cover which is attached to the main body along one side and is opened by closure means, the interior of the main body and cover having pockets for retaining objects in a visible and organized manner so that the objects are readily accessible, the closed first exterior wing accessory pocket having a longitudinal channel along its exterior inwardly facing sidewall; (b) a second exterior wing accessory pocket on the opposite side of the rear face and having a main body and a front cover which is attached to the main body along one side and is opened by closure means, the interior of the main body and cover having pockets for retaining objects in a visible and organized manner so that the objects are readily accessible, the closed second exterior wing accessory pocket having a longitudinal channel along its exterior inwardly facing sidewall, the first and second exterior wing accessory pockets being parallel to each other so that their respective inwardly facing longitudinal channels are parallel, and a space formed between the first and second exterior wing accessory pockets and between their respective longitudinal channels; and (c) a bottom pocket positioned below and spaced apart from the first and second exterior wing accessory pockets and aligned with the space between the two exterior wing accessory pockets, the bottom pocket having a main body and a front cover with a pair of oppositely disposed closure means, the bottom pocket having an interior compartment between the main body and the front cover; and (d) a multiplicity of cinch straps located above the bottom pocket and longitudinally spaced apart along the space between the two exterior wing accessory pockets; (e) whereby, the tripod is retained on the photographic equipment backpack by having the bottom of the first leg retained in the compartment of the bottom pocket and a portion of the leg is positioned along the longitudinal channel of the first exterior wing accessory pocket, the bottom of the second leg retained in the compartment of the bottom pocket and a portion of the leg is positioned along the longitudinal channel of the second exterior wing accessory pocket, the middle third leg resting outside the bottom pocket, the closure means of the bottom pocket tightly enclosing the bottom of the first and second tripod legs, and the multiplicity of cinch straps wrapped around the three legs to further support the tripod on the photographic equipment backpack.

Defined broadly, the present invention is an equipment backpack having a rear face and which can retain a tripod having at least a first leg and a second leg, the equipment backpack comprising: (a) a first exterior wing accessory pocket on one side of the rear face which has a longitudinal channel on its exterior inwardly facing sidewall; (b) a second exterior wing accessory pocket on the opposite side of the rear face and having a longitudinal channel along its exterior inwardly facing sidewall so that the longitudinal channels of the first exterior accessory wing pocket and the second exterior wing accessory pocket are spaced apart and parallel to each other with a space on the rear face between the two longitudinal channels; (c) a bottom pocket positioned below and spaced apart from the first and second exterior wing accessory pockets and aligned with the space between the longitudinal sidewalls of the first and second exterior wing accessory pockets, the bottom pocket having a main body and a front cover with closure means thereon, the bottom pocket, having an interior compartment between the main body and the front cover; and (d) at least one cinch strap located above the bottom pocket and located in the space between the longitudinal channels of the first and second exterior wing accessory pockets;

(e) whereby the tripod is retained on the equipment backpack by having the bottom of its first leg retained in the interior compartment of the bottom pocket and having a portion of the leg retained against the longitudinal channel of the first exterior wing accessory pocket, the bottom of the second leg is retained in the interior compartment of the bottom pocket and having a portion of the leg retained against the longitudinal channel of the second exterior wing accessory pocket, and the closure means on the bottom pocket securely retain the bottom of the legs therein, and the at least one cinch strap is wrapped around the legs to further securely retain the tripod on the equipment backpack.

Defined more broadly, the present invention is an equipment backpack having a rear face and which can retain a tripod having at least a first leg and a second leg, the equipment backpack comprising: (a) a bottom pocket positioned adjacent a bottom of the rear face, the bottom pocket having a main body and a front cover with closure means thereon, the bottom pocket having an interior compartment between the main body and the front cover; and (b) at least one cinch strap located on the rear face of the backpack and vertically positioned above the bottom pocket on the rear face; (c) whereby, the tripod is retained on the backpack by having the bottom of the first leg and the bottom of the second leg retained within the interior compartment of the bottom pocket and securely retained therein by the closure means, the at least one cinch strap wrapped around the at least two legs of the tripod to securely retain the tripod on the equipment backpack.

Defined even more broadly, the present invention is an equipment backpack having a rear face, the equipment backpack comprising: (a) a first exterior wing accessory pocket on one side of the rear face and having a main body and a front cover which is attached to the main body along one side and is opened by closure means, the interior of the main body and cover having pockets for retaining objects in a visible, organized and readily accessible manner; and (b) a second exterior wing accessory pocket on the opposite side of the rear face and having a main body and a front cover which is attached to the main body along one side and is opened by closure means, the interior of the main body and cover having pockets for retaining objects in a visible, organized and readily accessible manner, the first and second exterior wing accessory pockets being parallel to each other.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A photographic equipment backpack including a main body having a front face, a rear face, and two side faces, the two side faces extending between the front face and the rear face, and which is used in conjunction with a tripod having a first leg, a second leg, and a third middle leg, the photographic equipment backpack comprising:

a. a first exterior wing accessory pocket having a main body and a front cover on one side of said rear face with the first exterior wing accessory pocket being openable, and having a longitudinal channel along its exterior inwardly facing sidewall;

b. a second exterior wing accessory pocket having a main body and a front cover on an opposite side of said rear face with the second exterior wing accessory pocket being openable, and having a longitudinal channel along its exterior inwardly facing sidewall;

c. the first and second exterior wing accessory pockets being parallel to each other so that their respective inwardly facing longitudinal channels are parallel, and a space formed between the first and second exterior wing accessory pockets and between their respective longitudinal channels; and there is an exterior bottom pocket on the rear face of said photographic equipment backpack positioned below and spaced apart from said first and second exterior wing accessory pockets d. a first lower cinch strap, a second middle cinch strap and a third top cinch strap located above the bottom pocket and longitudinally spaced apart along the space between the two exterior wing accessory pockets, the first lower cinch strap having a pair of oppositely disposed strap members, each of which is attached at one end to the rear surface at a location between the first and second exterior wing pockets and connected at their opposite ends by closing means so that the first lower cinch strap is located immediately above the bottom pocket and adjacent lower ends of the main bodies of the respective first and second exterior wing pockets, the second middle cinch strap having a pair of oppositely disposed strap members, each of which is attached at one end to the rear surface at a location between the first and second exterior wing pockets and connected at their opposite ends by closing means so that the second middle cinch strap is located higher up on the rear surface and adjacent two-thirds of a distance up the respective first and second exterior wing pockets, and the third top cinch strap having a pair of oppositely disposed strap members, each of which is attached at one end to the top of the photographic equipment backpack and connected at their opposite ends by closing means so that the third cinch strap is located at the top of the photographic equipment backpack; and e. the photographic equipment backpack retaining legs of the tripod wherein the first lower, second middle and third top of the respective cinch straps wrapped around the first, second and third legs of the tripod to support the tripod on the photographic equipment backpack.

2. A photographic equipment backpack including a main body having a front face, a rear face, and two side faces, the two side faces extending between the front face and the rear face, and which is used in conjunction with a tripod having a first leg, a second leg, and a third middle leg, the photographic equipment backpack comprising:

a. a first exterior wing accessory pocket having a main body and a front cover on one side of said rear face with the first exterior wing accessory pocket being openable, and having a longitudinal channel along its exterior inwardly facing sidewall;

b. a second exterior wing accessory pocket having a main body and a front cover on an opposite side of said rear face with the second exterior wing accessory pocket being openable, and having a longitudinal channel along its exterior inwardly facing sidewall;

c. the first and second exterior wing accessory pockets being parallel to each other so that their respective inwardly facing longitudinal channels are parallel, and a space is formed between the first and second exterior wing accessory pockets and between their respective longitudinal channels;

d. an exterior bottom pocket on the rear face of said photographic equipment backpack positioned below and spaced apart from said first and second exterior wing accessory pockets;

e. a first lower cinch strap, a second middle cinch strap and a third top cinch strap located above the bottom pocket and longitudinally spaced apart along the space between the two exterior wing accessory pockets, the first lower cinch strap having a pair of oppositely disposed strap members, each of which is attached at one end to the rear surface at a location between the first and second exterior wing pockets and connected at their opposite ends by closing means so that the first lower cinch strap is located immediately above the bottom pocket and adjacent lower ends of the main bodies of the respective first and second exterior wing pockets, the second middle cinch strap having a pair of oppositely disposed strap members, each of which is attached at one end to the rear surface at a location between the first and second exterior wing pockets and connected at their opposite ends by closing means so that the second middle cinch strap is located higher up on the rear surface and adjacent two-thirds of a distance up the respective first and second exterior wing pockets, and the third top cinch strap having a pair of oppositely disposed strap members, each of which is attached at one end to the top of the photographic equipment backpack and connected at their opposite ends by closing means so that the third cinch strap is located at the top of the photographic equipment backpack; and f. the photographic equipment backpack retaining legs of the tripod wherein the first lower, second middle and third top of the respective cinch straps wrapped around three legs of the tripod to support the tripod on the photographic equipment backpack.

3. The photographic equipment backpack in accordance with claim 2 further comprising: the first exterior wing accessory pocket having a multiplicity of separate interior pockets on an interior of the main body of the first wing accessory pocket supported by an interior wall of the backpack and a multiplicity of separate pockets on an interior of the front cover of the first wing accessory pocket, with each of the multiplicity of pockets having a horizontal opening leading to the interior of the pocket into which a respective small object can be inserted, retained and retrieved so that each of the small objects are readily accessible, the first exterior wing accessory pocket having zipper closing means running along a mating circumference of the front cover and main body, and the second exterior wing accessory pocket having a multiplicity of separate interior pockets on an interior of the main body of the second wing accessory pocket supported by an interior wall of the backpack and a multiplicity of separate pockets on an interior of the front cover of the second wing accessory pocket, with each of the multiplicity of pockets having a horizontal opening leading to the interior of the pocket into which a respective small object can be inserted, retained and retrieved so that each of the small objects are readily accessible, the second exterior wing accessory pocket having zipper closing means running along a mating circumference of the front cover and main body.

4. The photographic equipment backpack in accordance with claim 2 further comprising: a center of said bottom pocket is aligned with the space between the two exterior wing accessory pockets, the bottom pocket having a main body and a front cover with a pair of oppositely disposed closure means incorporated into the bottom pocket, the bottom pocket having an interior compartment between the main body and the front cover.

5. The photographic equipment backpack in accordance with claim 2 further comprising: when retaining the tripod, by having a bottom of the first leg of the tripod retained in the compartment of the bottom pocket and a portion of the first leg of the tripod positioned along and at least partially retained in the longitudinal channel of the first exterior wing accessory pocket, a bottom of a second leg of the tripod retained in the compartment of the bottom pocket and a portion of a second leg of a tripod positioned along and at least partially retained in the longitudinal channel of the second exterior wing accessory pocket, a middle third leg of the tripod positioned to rest outside of the bottom pocket, the closure means which are incorporated into the bottom pocket enclosing the bottom of the first leg of the tripod and the bottom of the second leg of the tripod when the closure means is in the closed position.

6. The photographic equipment backpack in accordance with claim 2 further comprising: the backpack further comprising a front cover which is attached to the main body by mating zipper closure means located at a mating circumference of the front cover and main body, the main body having an interior chamber housing a multiplicity of separate interior compartments with each interior compartment having vertical and horizontal walls, the interior wall of the backpack forming the interior wall of each compartment, each interior compartment having an open front face, the front cover folding outwardly from the main body when the zipper closure member is opened to gain access to the multiplicity of interior compartments, the multiplicity of interior compartments facilitating retaining photographic equipment in a visible and organized manner, the open faces of the interior compartments allowing access to objects retained within each compartment when the front cover is folded outwardly, the front cover having a multiplicity of interior pockets in interior surface.

7. The photographic equipment backpack in accordance with claim 2, wherein the interior compartment of said bottom pocket is lined with reinforcing means to provide additional strength and gripping ability.

8. The photographic equipment backpack in accordance with claim 2, wherein said first exterior wing accessory pocket and said second exterior wing accessory pocket are the same size.

9. The photographic equipment backpack in accordance with claim 2, wherein said first exterior wing accessory pocket and said second exterior wing accessory pocket are of different sizes.

10. The photographic equipment backpack in accordance with claim 2, wherein said closure means of said first exterior wing accessory pocket is a zipper, said closure means of said second exterior wing accessory pocket is a zipper and the closure means on the bottom pocket is a pair of oppositely disposed zippers.

11. A photographic equipment backpack including a main body having a front face, a rear face, and two side faces, the two side faces extending between the front face and the rear face, and which is used in conjunction with a tripod having a first leg, a second leg, and a third middle leg, the photographic equipment backpack comprising:

a. a first exterior wing accessory pocket having a main body and a front cover on one side of said rear face with the first exterior wing accessory pocket being openable, the first exterior wing accessory pocket having zipper closing means running along a mating circumference of the front cover and main body, and when closed, the first exterior wing accessory pocket having a longitudinal channel along its exterior inwardly facing sidewall;

b. a second exterior wing accessory pocket having a main body and a front cover on an opposite side of said rear face with the second exterior wing accessory pocket being openable, the second exterior wing accessory pocket having zipper closing means running along a mating circumference of the front cover and main body, and when closed, the second exterior wing accessory pocket having a longitudinal channel along its exterior inwardly facing sidewall;

c. the first and second exterior wing accessory pockets being parallel to each other so that their respective inwardly facing longitudinal channels are parallel, and a space is formed between the first and second exterior wing accessory pockets and between their respective longitudinal channels;

d. an exterior bottom pocket on the rear face of said photographic equipment backpack positioned below and spaced apart from said first and second exterior wing accessory pockets and wherein a center of said bottom pocket is aligned with the space between the two exterior wing accessory pockets, the bottom pocket having a main body and a front cover with a pair of oppositely disposed closure means incorporated into the bottom pocket, the bottom pocket having an interior compartment between the main body and the front cover;

e. a first lower cinch strap, a second middle cinch strap and a third top cinch strap located above the bottom pocket and longitudinally spaced apart along the space between the two exterior wing accessory pockets, the first lower cinch strap having a pair of oppositely disposed strap members, each of which is attached at one end to the rear surface at a location between the first and second exterior wing pockets and connected at their opposite ends by closing means so that the first lower cinch strap is located immediately above the bottom pocket and adjacent lower ends of the main bodies of the respective first and second exterior wing pockets, the second middle cinch strap having a pair of oppositely disposed strap members, each of which is attached at one end to the rear surface at a location between the first and second exterior wing pockets and connected at their opposite ends by closing means so that the second middle cinch strap is located higher up on the rear surface and adjacent two-thirds of a distance up the respective first and second exterior wing pockets, and the third top cinch strap having a pair of oppositely disposed strap members, each of which is attached at one end to the top of the photographic equipment backpack and connected at their opposite ends by closing means so that the third cinch strap is located at the top of the photographic equipment backpack; and f. the photographic equipment backpack retaining legs of the tripod by having a bottom of the first leg of the tripod retained in the compartment of the bottom pocket and a portion of the first leg of the tripod positioned along and at least partially retained in the longitudinal channel of the first exterior wing accessory pocket, a bottom of a second leg of the tripod retained in the compartment of the bottom pocket and a portion of a second leg of a tripod positioned along and at least partially retained in the longitudinal channel of the second exterior wing accessory pocket, a middle third leg of the tripod positioned to rest outside of the bottom pocket, the closure means which are incorporated into the bottom pocket enclosing the bottom of the first leg of the tripod and the bottom of the second leg of the tripod when the closure means is in the closed position, and the first lower, second middle and third top of the respective cinch straps wrapped around three legs of the tripod to further support the tripod on the photographic equipment backpack.

12. The photographic equipment backpack in accordance with claim 11 further comprising: the first exterior wing accessory pocket having a multiplicity of separate interior pockets on an interior of the main body of the first wing accessory pocket supported by an interior wall of the backpack and a multiplicity of separate pockets on an interior of the front cover of the first wing accessory pocket, with each of the multiplicity of pockets having a horizontal opening leading to the interior of the pocket into which a respective small object can be inserted, retained and retrieved so that each of the small objects are readily accessible, and the second exterior wing accessory pocket having a multiplicity of separate interior pockets on an interior of the main body of the second wing accessory pocket supported by an interior wall of the backpack and a multiplicity of separate pockets on an interior of the front cover of the second wing accessory pocket, with each of the multiplicity of pockets having a horizontal opening leading to the interior of the pocket into which a respective small object can be inserted, retained and retrieved so that each of the small objects are readily accessible.

13. The photographic equipment backpack in accordance with claim 11 further comprising: the backpack further comprising a front cover which is attached to the main body by mating zipper closure means located at a mating circumference of the front cover and main body, the main body having an interior chamber housing a multiplicity of separate interior compartments with each interior compartment having vertical and horizontal walls, the interior wall of the backpack forming the interior wall of each compartment, each interior compartment having an open front face, the front cover folding outwardly from the main body when the zipper closure member is opened to gain access to the multiplicity of interior compartments, the multiplicity of interior compartments facilitating retaining photographic equipment in a visible and organized manner, the open faces of the interior compartments allowing access to objects retained within each compartment when the front cover is folded outwardly, the front cover having a multiplicity of interior pockets in interior surface.

14. The photographic equipment backpack in accordance with claim 11, wherein the interior compartment of said bottom pocket is lined with reinforcing means to provide additional strength and gripping ability.

15. The photographic equipment backpack in accordance with claim 11, wherein said first exterior wing accessory pocket and said second exterior wing accessory pocket are the same size.

16. The photographic equipment backpack in accordance with claim 11, wherein said first exterior wing accessory pocket and said second exterior wing accessory pocket are of different sizes.

17. The photographic equipment backpack in accordance with claim 11, wherein said closure means of said first exterior wing accessory pocket is a zipper, said closure means of said second exterior wing accessory pocket is a zipper and the closure means on the bottom pocket is a pair of oppositely disposed zippers.

18. A photographic equipment backpack including a main body having a front face, a rear face, and two side faces, the two side faces extending between the front face and the rear face, and which is used in conjunction with a tripod having a first leg, a second leg, and a third middle leg, the photographic equipment backpack comprising:

a. a first exterior wing accessory pocket having a main body and a front cover on one side of said rear face with the first exterior wing accessory pocket being openable and having a multiplicity of separate interior pockets on an interior of the main body of the first wing accessory pocket supported by an interior wall of the backpack and a multiplicity of separate pockets on an interior of the front cover of the first wing accessory pocket, with each of the multiplicity of pockets having a horizontal opening leading to the interior of the pocket into which a respective small object can be inserted, retained and retrieved so that each of the small objects are readily accessible, the first exterior wing accessory pocket having zipper closing means running along a mating circumference of the front cover and main body, and when closed, the first exterior wing accessory pocket having a longitudinal channel along its exterior inwardly facing sidewall;

b. a second exterior wing accessory pocket having a main body and a front cover on an opposite side of said rear face with the second exterior wing accessory pocket being openable and having a multiplicity of separate interior pockets on an interior of the main body of the second wing accessory pocket supported by an interior wall of the backpack and a multiplicity of separate pockets on an interior of the front cover of the second wing accessory pocket, with each of the multiplicity of pockets having a horizontal opening leading to the interior of the pocket into which a respective small object can be inserted, retained and retrieved so that each of the small objects are readily accessible, the second exterior wing accessory pocket having zipper closing means running along a mating circumference of the front cover and main body, and when closed, the second exterior wing accessory pocket having a longitudinal channel along its exterior inwardly facing sidewall;

c. the first and second exterior wing accessory pockets being parallel to each other so that their respective inwardly facing longitudinal channels are parallel, and a space is formed between the first and second exterior wing accessory pockets and between their respective longitudinal channels;

d. an exterior bottom pocket on the rear face of said photographic equipment backpack positioned below and spaced apart from said first and second exterior wing accessory pockets and wherein a center of said bottom pocket is aligned with the space between the two exterior wing accessory pockets, the bottom pocket having a main body and a front cover with a pair of oppositely disposed closure means incorporated into the bottom pocket, the bottom pocket having an interior compartment between the main body and the front cover;

e. a first lower cinch strap, a second middle cinch strap and a third top cinch strap located above the bottom pocket and longitudinally spaced apart along the space between the two exterior wing accessory pockets, the first lower cinch strap having a pair of oppositely disposed strap members, each of which is attached at one end to the rear surface at a location between the first and second exterior wing pockets and connected at their opposite ends by closing means so that the first lower cinch strap is located immediately above the bottom pocket and adjacent lower ends of the main bodies of the respective first and second exterior wing pockets, the second middle cinch strap having a pair of oppositely disposed strap members, each of which is attached at one end to the rear surface at a location between the first and second exterior wing pockets and connected at their opposite ends by closing means so that the second middle cinch strap is located higher up on the rear surface and adjacent two-thirds of a distance up the respective first and second exterior wing pockets, and the third top cinch strap having a pair of oppositely disposed strap members, each of which is attached at one end to the top of the photographic equipment backpack and connected at their opposite ends by closing means so that the third cinch strap is located at the top of the photographic equipment backpack;

f. the photographic equipment backpack retaining legs of the tripod by having a bottom of the first leg of the tripod retained in the compartment of the bottom pocket and a portion of the first leg of the tripod positioned along and at least partially retained in the longitudinal channel of the first exterior wing accessory pocket, a bottom of a second leg of the tripod retained in the compartment of the bottom pocket and a portion of a second leg of a tripod positioned along and at least partially retained in the longitudinal channel of the second exterior wing accessory pocket, a middle third leg of the tripod positioned to rest outside of the bottom pocket, the closure means which are incorporated into the bottom pocket enclosing the bottom of the first leg of the tripod and the bottom of the second leg of the tripod when the closure means is in the closed position, and the first lower, second middle and third top cinch straps wrapped around three legs of the tripod to further support the tripod on the photographic equipment backpack; and g. the backpack further comprising and a front cover which is attached to the main body by mating zipper closure means located at a mating circumference of the front cover and main body, the main body having an interior chamber housing a multiplicity of separate interior compartments with each interior compartment having vertical and horizontal walls, the interior wall of the backpack forming the interior wall of each compartment, each interior compartment having an open front face, the front cover folding outwardly from the main body when the zipper closure member is opened to gain access to the multiplicity of interior compartments, the multiplicity of interior compartments facilitating retaining photographic equipment in a visible and organized manner, the open faces of the interior compartments allowing rapid access to objects retained within each compartment when the front cover is folded outwardly, the front cover having a multiplicity of interior pockets in interior surface.

19. The photographic equipment backpack in accordance with claim 18, wherein the interior compartment of said bottom pocket is lined with reinforcing means to provide additional strength and gripping ability.

20. The photographic equipment backpack in accordance with claim 18, wherein said first exterior wing accessory pocket and said second exterior wing accessory pocket are the same size.

21. The photographic equipment backpack in accordance with claim 18, wherein said first exterior wing accessory pocket and said second exterior wing accessory pocket are of different sizes.

22. The photographic equipment backpack in accordance with claim 18, wherein said closure means of said first exterior wing accessory pocket is a zipper, said closure means of said second exterior wing accessory pocket is a zipper and the closure means on the bottom pocket is a pair of oppositely disposed zippers.

* * * * *